US010265953B2

(12) United States Patent
Ogura

(10) Patent No.: US 10,265,953 B2
(45) Date of Patent: Apr. 23, 2019

(54) INKJET PRINTER AND PRINTING METHOD

(71) Applicant: Roland DG Corporation, Hamamatsu-shi, Shizuoka (JP)

(72) Inventor: Yoshinari Ogura, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/953,615

(22) Filed: Apr. 16, 2018

(65) Prior Publication Data

US 2018/0297358 A1 Oct. 18, 2018

(30) Foreign Application Priority Data

Apr. 18, 2017 (JP) ..... 2017-082144

(51) Int. Cl.

| | |
|---|---|
| ***B41J 2/14*** | (2006.01) |
| ***B41J 2/21*** | (2006.01) |
| ***B41J 2/045*** | (2006.01) |
| ***B41J 2/155*** | (2006.01) |
| ***B41J 19/14*** | (2006.01) |
| ***B41J 25/00*** | (2006.01) |

(52) U.S. Cl.

CPC ..... *B41J 2/04581* (2013.01); *B41J 2/1433* (2013.01); *B41J 2/155* (2013.01); *B41J 2/2117* (2013.01); *B41J 19/142* (2013.01); *B41J 25/001* (2013.01)

(58) Field of Classification Search

CPC combination set(s) only.

See application file for complete search history.

(56) References Cited

U.S. PATENT DOCUMENTS

| | | | | |
|---|---|---|---|---|
| 6,402,295 | B1 | 6/2002 | Narushima | |
| 8,393,700 | B2 * | 3/2013 | Otsuka | B41J 11/002 347/101 |
| 8,888,270 | B2 * | 11/2014 | Kachi | B41J 11/002 347/102 |
| 9,056,457 | B2 * | 6/2015 | Hasegawa | B41J 19/145 |

(Continued)

FOREIGN PATENT DOCUMENTS

| | | | |
|---|---|---|---|
| JP | 06-122209 | A | 5/1994 |
| JP | 09-314821 | A | 12/1997 |

(Continued)

*Primary Examiner* — Matthew Luu
*Assistant Examiner* — Lily K Kemathe
(74) *Attorney, Agent, or Firm* — Keating & Bennett, LLP

(57) ABSTRACT

In an inkjet printer capable of performing an overprint process by feeding only in a first direction while reducing clogging of nozzles, a controller includes first, second and third controllers. The third controller instructs the first controller to perform a first image-printing scan, a first minute feed and a second image-printing scan without discharging an image ink from a first nozzle at an end portion of a first nozzle row in a first direction along a secondary scan direction; then performs a second minute feed of feeding a recording medium in the first direction along the secondary scan direction relative to a discharge head; and then instructs the second controller to perform a first base-printing scan, a first minute feed and a second base-printing scan without discharging a base ink from a second nozzle at an end portion of a second nozzle row in a second direction, opposite to the first direction, along the secondary scan direction.

12 Claims, 12 Drawing Sheets

(56) References Cited

U.S. PATENT DOCUMENTS 9,539,807 B2 * 1/2017 Sato ..... B41J 2/2132
2004/0207685 A1 10/2004 Otsuki
2006/0146080 A1 7/2006 Fukuyasu
2006/0158473 A1 7/2006 Mills et al.
2006/0170937 A1 * 8/2006 Takahashi ..... B41J 2/2139 358/1.8
2007/0057986 A1 * 3/2007 Arazaki ..... B41J 2/2135 347/15
2009/0244168 A1 * 10/2009 Kakutani ..... B41J 2/2107 347/21
2011/0235069 A1 * 9/2011 Otsuka ..... B41J 2/15 358/1.8
2012/0001973 A1 * 1/2012 Sano ..... B41J 2/2117 347/12
2013/0194333 A1 * 8/2013 Ito ..... B41J 19/147 347/12
2014/0340456 A1 * 11/2014 Waschnig ..... B41M 7/0081 347/102
2015/0266298 A1 * 9/2015 Kifuku ..... B41J 2/16508 347/9
2015/0375530 A1 * 12/2015 Andrea-Tallada ..... B41J 11/002 347/102
2018/0297358 A1 * 10/2018 Ogura ..... B41J 2/04581
2018/0297372 A1 * 10/2018 Ogura ..... B41J 2/2135
2018/0316826 A1 * 11/2018 Ogura ..... H04N 1/603

FOREIGN PATENT DOCUMENTS

JP 2000-318147 A 11/2000
JP 2003-062986 A 3/2003
JP 2004-034530 A 2/2004
JP 2005-144893 A 6/2005
JP 2006-231930 A 9/2006
JP 2010-005811 A 1/2010
JP 2013-078903 A 5/2013
JP 2014-031023 A 2/2014
JP 5629360 B2 11/2014

* cited by examiner

INKJET PRINTER AND PRINTING METHOD

CROSS REFERENCE TO RELATED APPLICATIONS

This application claims the benefit of priority to Japanese Patent Application No. 2017-082144 filed on Apr. 18, 2017. The entire contents of this application are hereby incorporated herein by reference.

BACKGROUND OF THE INVENTION

1. Field of the Invention

The present invention relates to an inkjet printer and a printing method.

2. Description of the Related Art

Inkjet-type printing devices configured to discharge droplets of ink onto a recording medium so that the droplets land on the recording medium, thus realizing an intended printing result are known in the art as conventional printing devices for printing images. A printing device of this type includes an ink head for discharging ink, and discharges ink toward a recording medium while moving the ink head in the primary scan direction. When a print process for a scanning line is finished, the printing device feeds the recording medium over a predetermined pitch in the secondary scan direction, and a print process is performed successively for another scanning line at the position after the recording medium has been fed. Thus, an image of characters, patterns, etc., is printed.

Now, in recent years, an overprint process has been used, wherein a base layer is printed on a recording medium in advance using a white pigment ink, or the like, having a high optical reflectivity, and then an intended image is printed on the base layer, so that the image appears vividly in intended colors, irrespective of the properties of the recording medium, for example.

For overprinting, a print process is performed twice at each predetermined position, wherein a base layer is printed on a recording medium and then an image layer is printed on the printed base layer. If the two print processes are performed successively by reciprocating the ink head, ink does not dry in time, and the color of a base ink and the color of an image ink get mixed together. In view of this, there is another method in which after the entire base layer is printed, the recording medium is fed in the reverse direction (from the downstream side toward the upstream side), and then the image layer is printed on the base layer. In contrast, Japanese Patent No. 5629360 discloses a process of overprinting while feeding the recording medium only in one direction (from the upstream side toward the downstream side) by a printing method as follows. That is, the ink head is divided into an upstream half and a downstream half with respect to the secondary scan direction, wherein first, a base ink is discharged from ink discharge ports (nozzles) provided in the upstream half of the ink head so as to print the base layer. Then, the recording medium is fed downstream only by half the ink head while drying the printed base ink using a heater. Then, an image ink is discharged from ink discharge ports provided in the downstream half of the ink head onto the base layer on the recording medium having been fed thereto so as to overprint an image thereon, while a base ink is discharged from ink discharge ports provided in the upstream half so as to print the next base layer.

However, with the printing method disclosed in Japanese Patent No. 5629360, the upstream half of the ink head only prints a base layer and does not print an image layer. The downstream half of the ink head only prints an image layer and does not print a base layer. That is, during the overprint process, the image ink discharge ports of the upstream half of the ink head and the base ink discharge ports of the downstream half of the ink head always remain unused. Therefore, if the overprint process continues over a long time, ink in the discharge ports is likely to dry, and discharge failure and clogging are likely to occur in many discharge ports. With the overprint process of Japanese Patent No. 5629360, since the process of printing the base layer and the process of printing the image layer are performed continuously, it is necessary to perform a drying step using a heater, and the insertion of the drying step accelerates the drying of discharge ports that are not used for the overprint process.

SUMMARY OF THE INVENTION

In view of the above, preferred embodiments of the present invention provide inkjet printers capable of performing an overprint process by feeding only in one direction while reducing clogging of nozzles, and provide printing methods capable of performing an overprint process by feeding only in one direction while reducing clogging of nozzles.

The techniques disclosed herein provide inkjet printers including a discharge head, a scanner, a feeder and a controller. In the inkjet printer, the discharge head includes a first nozzle row and a second nozzle row, the first nozzle row including a plurality of first nozzles arranged next to each other in a secondary scan direction to discharge an image ink onto a recording medium, and the second nozzle row including a plurality of second nozzles arranged next to each other in the secondary scan direction to discharge a base ink onto the recording medium, wherein the first nozzle row and the second nozzle row are arranged next to each other in a primary scan direction that crosses the secondary scan direction. The scanner moves the discharge head in the primary scan direction. The feeder moves at least one of the recording medium and the discharge head so as to feed the recording medium in the secondary scan direction relative to the discharge head. The controller controls the discharge head, the scanner and the feeder. A length and a nozzle pitch of the first nozzle row in the secondary scan direction are equal or substantially equal to a length and a nozzle pitch of the second nozzle row in the secondary scan direction. The controller is configured or programmed to include a first controller, a second controller and a third controller. The first controller performs at least a first image-printing scan of discharging the image ink from the first nozzles while moving the discharge head in the primary scan direction so as to form first image ink dots in a predetermined area of the recording medium, a first minute feed of feeding the recording medium by a first feed distance in a first direction along the secondary scan direction relative to the discharge head, and a second image-printing scan of discharging the image ink from the first nozzles while moving the discharge head in the primary scan direction so as to form second image ink dots in the predetermined area of the recording medium and next to the first image ink dots in the secondary scan direction. The second controller performs at least a first base-printing scan of discharging the base ink from the second nozzles while moving the discharge head in the primary scan direction so as to form first base ink dots in the predetermined area of the recording medium, the first minute feed, and a second base-printing scan of discharging the base ink from the second nozzles while moving the discharge head in the primary scan direction so as to form second base ink dots in the predetermined area of the recording medium and next to the first base ink dots in the secondary scan direction. The third controller: (1) instructs the first controller to perform the first image-printing scan, the first minute feed and the second image-printing scan without discharging the image ink from a first nozzle that is located at an end portion of the first nozzle row in the first direction other than a central portion of the first nozzle row in the secondary scan direction; then performs a second minute feed of feeding the recording medium by a second feed distance in the first direction along the secondary scan direction relative to the discharge head; and then instructs the second controller to perform the first base-printing scan, the first minute feed and the second base-printing scan without discharging the base ink from a second nozzle that is located at an end portion of the second nozzle row in a second direction opposite to the first direction other than a central portion of the second nozzle row in the secondary scan direction; or (2) instructs the second controller to perform the first base-printing scan, the first minute feed and the second base-printing scan without discharging the base ink from a second nozzle that is located at an end portion of the second nozzle row in the first direction other than the central portion of the second nozzle row in the secondary scan direction; then performs the second minute feed of feeding the recording medium by the second feed distance in the first direction along the secondary scan direction relative to the discharge head; and then instructs the first controller to perform the first image-printing scan, the first minute feed and the second image-printing scan without discharging the image ink from a first nozzle that is located at an end portion of the first nozzle row in the second direction other than the central portion of the first nozzle row in the secondary scan direction.

With the configuration described above, it is possible to perform an overprint process while feeding the recording medium only in the first direction along the secondary scan direction, wherein (1) base ink dots are printed by the second controller over image ink dots that have been printed by the first controller, or (2) image ink dots are printed by the first controller over base ink dots that have been printed by the second controller. Thus, an intended image is able to be overprinted without smudging the print surface. In this process, for one of the first nozzle row and the second nozzle row that is to perform a print process first, ink is not discharged from a nozzle that is located at an end portion of the nozzle row in the first direction along the secondary scan direction, and for one of the first nozzle row and the second nozzle row that is to perform a print process later, ink is not discharged from a nozzle that is located at an end portion of the nozzle row in the second direction along the secondary scan direction. Note however that with both of the first nozzle row and the second nozzle row, those nozzles that are located in the central portion of the nozzle row in the secondary scan direction are used for printing. Thus, it is possible to reduce the number of nozzles that are not used for overprinting and to reduce the lowering of the print quality. The base layer and the image layer are each printed by at least two print scans. Thus, it is possible to print high-definition images, and it is also possible to ensure a long period of time between the print process for the two layers, thus reducing the color mixing between the base ink and the image ink.

Preferred embodiments of the present invention provide inkjet printers capable of performing a high-definition overprint process by feeding only in one direction while reducing clogging of nozzles.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Inkjet printers and printing methods according to preferred embodiments of the present invention will now be described with reference to the drawings. Note that the preferred embodiments to be described hereinbelow are not intended to limit the scope of the present invention. Elements and features performing the same function will be denoted by the same reference signs, and redundant descriptions will be omitted or simplified.

Note that an "inkjet printer" (hereinafter also referred to simply as a "printer") as used herein generally refers to a device that discharges a liquid such as ink in the form of minute droplets so as to supply the liquid to a target recording medium, or the like, thus recording information. With such printers, there is no particular limitation on the method of forming droplets. For example, any of various methods known in the art can be used with no particular limitation, e.g., continuous printing such as binary deflection printing or continuous deflection printing, and on-demand printing such as thermal printing or piezoelectric printing.

First Preferred Embodiment

Figure 1:
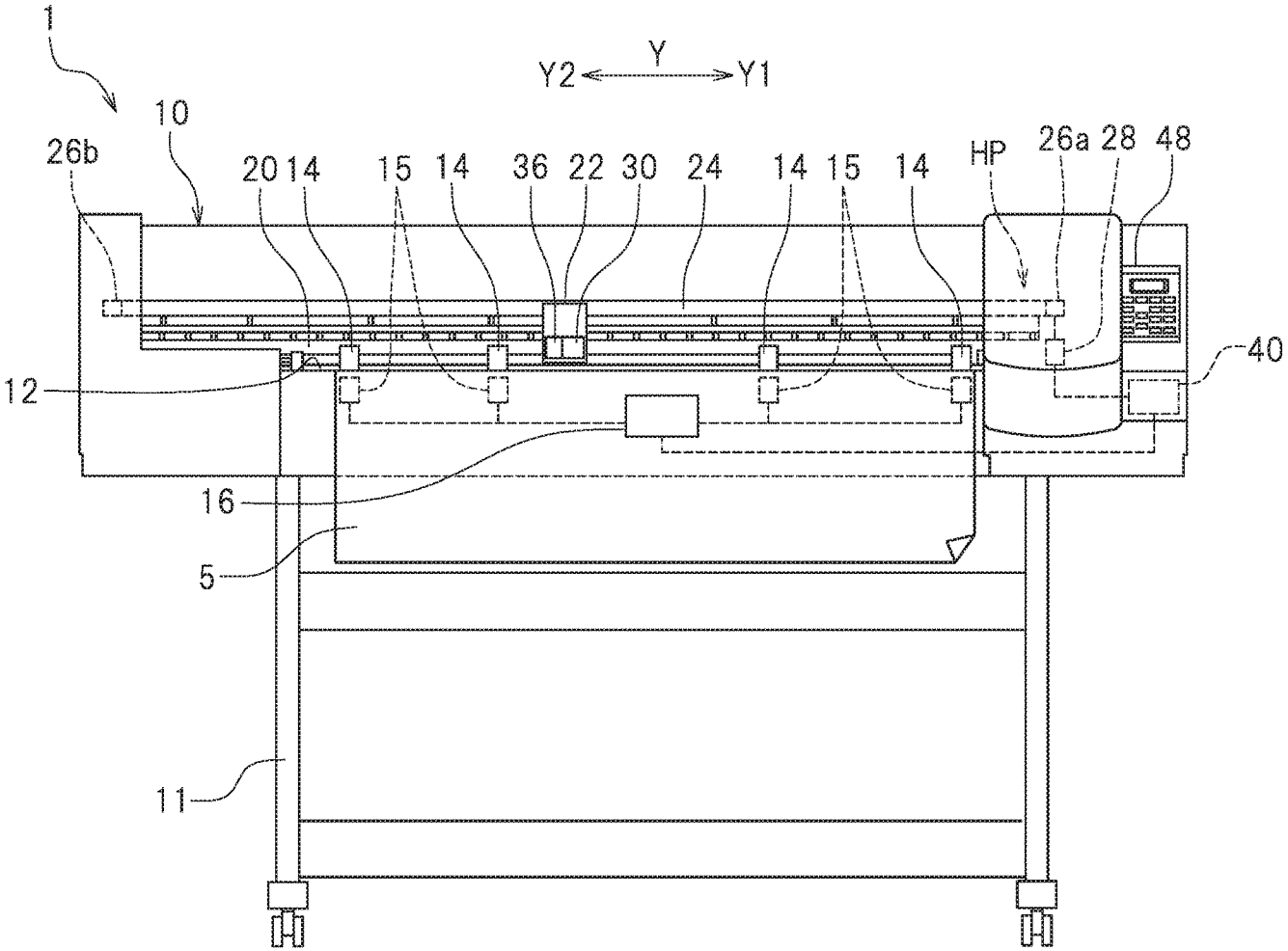
FIG. 1 is a front view showing an inkjet printer according to one preferred embodiment of the present invention.

FIG. 1 is a front view showing a printer 1 according to one preferred embodiment of the present invention. In the following description, the direction away from the printer 1 is defined as forward and the direction toward the printer 1 as rearward, as the printer 1 is seen from the front side. In the drawings, reference sign Y denotes the primary scan direction, and reference signs Y1 and Y2 denote the rightward direction and the leftward direction, respectively, as the printer 1 is seen from the front side. In the present preferred embodiment, the direction that crosses the primary scan direction Y on a horizontal plane is defined as the secondary scan direction X (see FIG. 2). The primary scan direction Y and the secondary scan direction X are perpendicular to each other, and the secondary scan direction X coincides with the front-rear direction. In the present preferred embodiment, the first direction X1 and the second direction X2 respectively denote the forward direction and the rearward direction along the secondary scan direction X. Note however that these designations of direction are used merely for the purpose of illustration, and do not limit how the inkjet printer is installed, etc.

The printer 1 prints an image of characters, patterns, etc., on the recording medium 5 by discharging ink onto a recording medium 5 from a discharge head 30 that moves in the primary scan direction Y while moving the recording medium 5 in the secondary scan direction X at intervals. The recording medium 5 is an object on which an image is printed. There is no particular limitation on the type of the recording medium 5. The recording medium 5 may be paper such as plain paper, but may also be a resin material such as polyvinyl chloride (PVC) or polyester, or any of various other materials such as aluminum, iron and wood. The recording medium 5 may be in the form of a flexible sheet such as cut-sheet paper or continuous paper, in the form of a plate having a certain shape, or in the form of an article having any shape. Moreover, there is no particular limitation on the size of the recording medium 5. Since the printer 1 according to a preferred embodiment of the present invention is capable of printing with one-way feeding, the advantages of various preferred embodiments of the present invention are able to be achieved particularly with a printer that is capable of printing on a large-size recording medium (e.g., a roll medium having a width of the A1 size or more) 5.

The printer 1 includes a printer main body 10, and legs 11 that support the printer main body 10. The printer main body 10 has a box shape that is elongated in the primary scan direction Y. A guide rail 20 and a carriage 22 in engagement with the guide rail 20 are accommodated in the printer main body 10. The carriage 22 holds and moves the discharge head 30 to be described below. The guide rail 20 extends in the primary scan direction Y inside the printer main body 10. The guide rail 20 guides the movement of the carriage 22 in the primary scan direction Y. An endless belt 24 is fixed to the carriage 22. The belt 24 is wound, with no slack, between a pair of pulleys 26*a* and 26*b*, which are provided on the right side and the left side, respectively, of the guide rail 20. A carriage motor 28 is attached to the right pulley 26*a*. The carriage motor 28 is electrically connected to a controller 40. The carriage motor 28 is controlled by the controller 40. When the carriage motor 28 is driven, the right pulley 26*a* rotates and the belt 24 runs around the pulleys 26*a* and 26*b*. The left pulley 26*b* follows the travel of the belt 24 and guides the straight travel of the belt 24. Thus, the carriage 22, which is fixed to the belt 24, moves in the primary scan direction Y along the guide rail 20. As a result, the discharge head 30 is able to be moved in the primary scan direction Y. In the present preferred embodiment, the carriage 22, the belt 24, the pulleys 26*a* and 26*b* and the carriage motor 28 together define a scanner that moves the discharge head 30 in the primary scan direction Y.

Under the carriage 22, a platen 12 is provided to extend in the primary scan direction Y. The platen 12 of this example is a plate-shaped member, for example. The platen 12 supports a print portion of the recording medium 5 in a horizontal position. On the rear side of the platen 12, a plurality of pairs of a pinch roller 14 and a grid roller 15 are provided along the primary scan direction Y. The pinch rollers 14 are provided above the platen 12 and elastically press the recording medium 5 from above. The grid rollers 15 are buried in the platen 12 at positions opposing the pinch rollers 14. The grid rollers 15 are capable of rotating about an axis extending in the primary scan direction Y. The grid rollers 15 are connected to a feed motor 16. The grid rollers 15 are rotated forward or backward by the driving force from the feed motor 16. The feed motor 16 is electrically connected to the controller 40. The feed motor 16 is controlled by the controller 40. The recording medium 5 is fed in the secondary scan direction X as the grid rollers 15 rotate, with the recording medium 5 is sandwiched between the pinch rollers 14 and the grid rollers 15. The pinch rollers 14 rotate about an axis extending in the primary scan direction Y following the feed of the recording medium 5 in the secondary scan direction X so as to prevent the recording medium 5 being fed from deviating, warping, etc. Note that the rotation of the feed motor 16 when the recording medium 5 is fed in the first direction X1 along the secondary scan direction X is referred to as the forward rotation, and that when the recording medium 5 is fed in the second direction X2 is referred to as the reverse rotation. In the present preferred embodiment, the first direction X1 side may be referred to as the downstream side and the second direction X2 side as the upstream side. In the present preferred embodiment, the pinch rollers 14, the grid rollers 15 and the feed motor 16 together define a feeder that moves the recording medium 5 in the secondary scan direction X.

Figure 2:
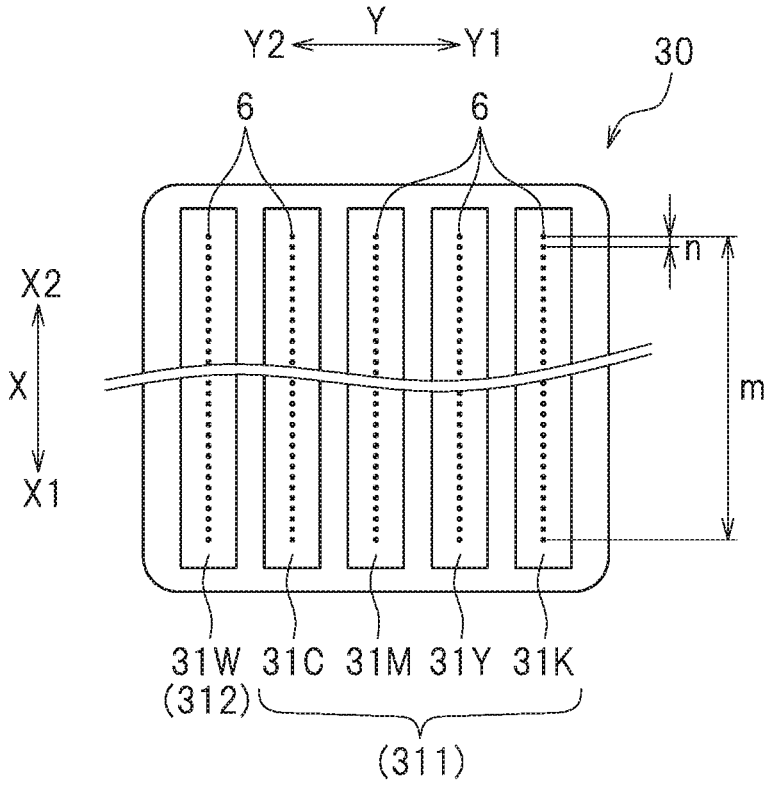
FIG. 2 is a schematic diagram showing a configuration of a lower surface of a discharge head according to one preferred embodiment of the present invention.

When no print operation is performed, the carriage 22 stands by at the home position HP at the right end of the guide rail 20. The carriage 22 includes the discharge head 30. FIG. 2 is a schematic diagram showing a configuration of a surface (the lower surface in the present preferred embodiment) of the discharge head 30 that opposes the recording medium 5. The discharge head 30 preferably includes five nozzle rows 31W, 31C, 31M, 31Y and 31K in this order from the left side, for example. Of the five nozzle rows 31W, 31C, 31M, 31Y and 31K, each of the four nozzle rows 31C, 31M, 31Y and 31K on the right side discharges a process color ink for forming a color image. The nozzle row 31C discharges a cyan ink. The nozzle row 31M discharges a magenta ink. The nozzle row 31Y discharges a yellow ink. The nozzle row 31K discharges a black ink. The nozzle row 31W on the far left discharges a white ink.

Each of the five nozzle rows 31W, 31C, 31M, 31Y and 31K includes a plurality of nozzles 6. The plurality of nozzles 6 are arranged along the secondary scan direction X. The five nozzle rows 31W, 31C, 31M, 31Y and 31K are arranged next to each other in the primary scan direction Y. In this example, the nozzle rows 31W, 31C, 31M, 31Y and 31K are arranged so that nozzles 6 from different rows are aligned in the primary scan direction Y. The positions in the secondary scan direction X of two nozzles 6 that are adjacent to each other in the primary scan direction Y coincide with each other. However, the arrangement of the nozzle rows 31W, 31C, 31M, 31Y and 31K is not limited to this. For example, the nozzle rows 31W, 31C, 31M, 31Y and 31K may be arranged so that nozzles 6 of the odd-numbered nozzle rows 31W, 31M and 31K starting from the left side are aligned in the primary scan direction Y while nozzles 6 of the remaining nozzle rows, i.e., the even-numbered nozzle rows 31C and 31Y starting from the left side, are located in the middle between nozzles 6 of the odd-numbered nozzle rows 31W, 31M and 31K both in the primary scan direction Y and in the secondary scan direction X (i.e., so that the nozzles 6 are arranged in a checkered pattern). The nozzle rows 31W, 31C, 31M, 31Y and 31K each have an equal length "m", i.e., the length from the center of a nozzle 6 that is located most forward in the nozzle row to the center of a nozzle 6 that is located most rearward. Each of the nozzle rows 31W, 31C, 31M, 31Y and 31K has an equal pitch "n" between nozzles 6 (the distance between nozzle centers; hereinafter simply as the "nozzle pitch"). Note that FIG. 2 shows the discharge head 30 while omitting a part of the length in the secondary scan direction. While FIG. 2 shows about 20 nozzles 6 in each of the nozzle rows 31W, 31C, 31M, 31Y and 31K, each nozzle row actually includes more (e.g., about 180) nozzles 6. Note that there is no limitation on the number or arrangement of nozzles 6.

In the present preferred embodiment, the process color ink corresponds to the image ink for forming the image layer. The four nozzle rows 31C, 31M, 31Y and 31K correspond to a first nozzle row 311. Moreover, nozzles 6 of the four nozzle rows 31C, 31M, 31Y and 31K correspond to the first nozzles. Note that the number of colors and the hues of image inks are not limited to those described above. In the present preferred embodiment, the white ink corresponds to the base ink for forming the base layer. The nozzle row 31W corresponds to a second nozzle row 312. Nozzles 6 of the nozzle row 31W correspond to the second nozzles.

Note that the "base layer" as used herein refers to a layer that reflects/blocks and is arranged under (on the back side of) an image layer as the image layer is seen by a person from the intended side. Therefore, the base layer does not always refer to a layer located under the image layer when a print process is performed. For example, when an image layer is printed on a transparent recording medium and a person is supposed to see the image layer from the side of the image layer printed on the recording medium, a print process is performed so that the base layer and the image layer are layered in this order on the recording medium. For example, when a person is supposed to see the image layer from the side of the transparent recording medium (i.e., through the recording medium), a print process is performed so that the image layer and the base layer are layered in this order from the recording medium.

Figure 3:
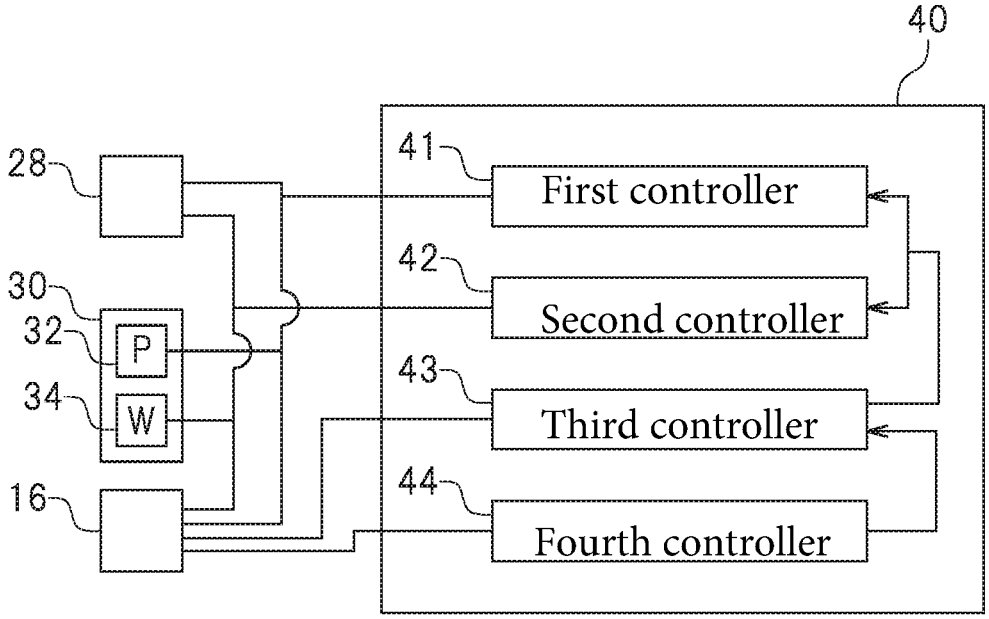
FIG. 3 is a block diagram showing a controller according to one preferred embodiment of the present invention.

Actuators 32 and 34 including a piezoelectric element therein are provided inside the discharge head 30 (see FIG. 3). As the actuators 32 and 34 piezoelectrically expand or contract in an instantaneous manner, ink is discharged toward the recording medium 5 from the nozzles 6 of the first nozzle row 311 and the second nozzle row 312. The actuators 32 and 34 are electrically connected to the controller 40, and the actuation thereof is controlled by the controller 40. Hereinafter, for the purpose of discussion, in the present preferred embodiment, actuators that control the discharge of image inks from first nozzle rows 311 are referred to collectively as a first actuator 32, and those that control the discharge of a base ink from the second nozzle row 312 are referred to collectively as a second actuator 34.

Each of the nozzle rows 31W, 31C, 31M, 31Y and 31K communicates with an ink cartridge (not shown) via an ink supply channel. The ink cartridges are removably placed at the right end portion of the printer main body 10, for example. Note that there is no particular limitation on the material of the ink, and the ink may include various colorants and media (which can be at least one of a solvent and a dispersion medium) that have conventionally been used as materials of ink of inkjet printers. For example, the ink may be a solvent-based pigment ink or an aqueous pigment ink, or may be an aqueous dye ink or a UV-curable pigment ink that cures by receiving UV light, etc.

As shown in FIG. 1, a control panel 48 is provided at the right end portion of the printer main body 10. The control panel 48 is provided with a display that displays the status of the printer 1 and the operation status of the printer 1, etc., and input keys used by the user to input instructions, etc. The controller 40 configured or programmed to control various operations of the printer 1 is accommodated on the inner side of the control panel 48.

There is no particular limitation on the configuration of the controller 40, and the controller 40 can be realized by various configurations or functions that are known in the art or that are to be developed in the future. The controller 40 may be a microcomputer, for example. There is no particular limitation on the hardware configuration of the microcomputer. For example, the microcomputer may include an interface (I/F) to transmit/receive information such as print data from an external device such as a host computer, a central processing unit (CPU) to execute commands of the control program, a ROM (read only memory) storing a program to be executed by the CPU, and a RAM (random access memory) used as a working area for expanding a program, and a storage such as a memory to store the program, print data, and various other data. Alternatively, the controller 40 may be implemented by a programmable logic device such as an FPGA (field-programmable gate array), for example. For example, an FPGA may include a CPU core formed by an integrated circuit, a multiplier, a RAM, and associated peripheral circuits, etc. Note that it is not always necessary that the controller 40 be provided inside the printer main body 10, and the controller 40 may be, for example, a computer, or the like, that is provided outside the printer main body 10 and communicably connected to the printer main body 10 via a wired connection or a wireless connection.

FIG. 3 is a block diagram showing a configuration of the controller 40 according to one preferred embodiment of the present invention. The controller 40 is communicably connected to the feed motor 16, the carriage motor 28 and the actuators 32 and 34, and is capable of centralized control of these components. The controller 40 preferably is configured or programmed to include a first controller 41, a second controller 42, a third controller 43 and a fourth controller 44, which can be part of the same controller or defined by one or more separate controllers. These controllers 41, 42, 43 and 44 of the controller 40 may each be implemented by hardware or functionally implemented by a computer program executed by the CPU. As will be described below, the functions to be implemented by the first controller 41, the second controller 42, the third controller 43 and the fourth controller 44 may be correlated to each other. Therefore, the first controller 41, the second controller 42, the third controller 43 and the fourth controller 44 do not always need to be structurally or logically independent of each other as long as an intended printing result is achieved. In the present preferred embodiment, these controllers preferably are each implemented by an integrated circuit. By controlling these controllers 41-44, the controller 40 performs an overprint process by discharging an image ink from the first nozzle row 311 based on the print data so as to print the image layer, and discharging a base ink from the second nozzle row 312 so as to print the base layer. With the printer 1 disclosed herein, each of the first controller 41, the second controller 42, the third controller 43 and the fourth controller 44 is able to directly or indirectly control the feed motor 16, the carriage motor 28 and the actuators 32 and 34 as described below.

Figure 4:
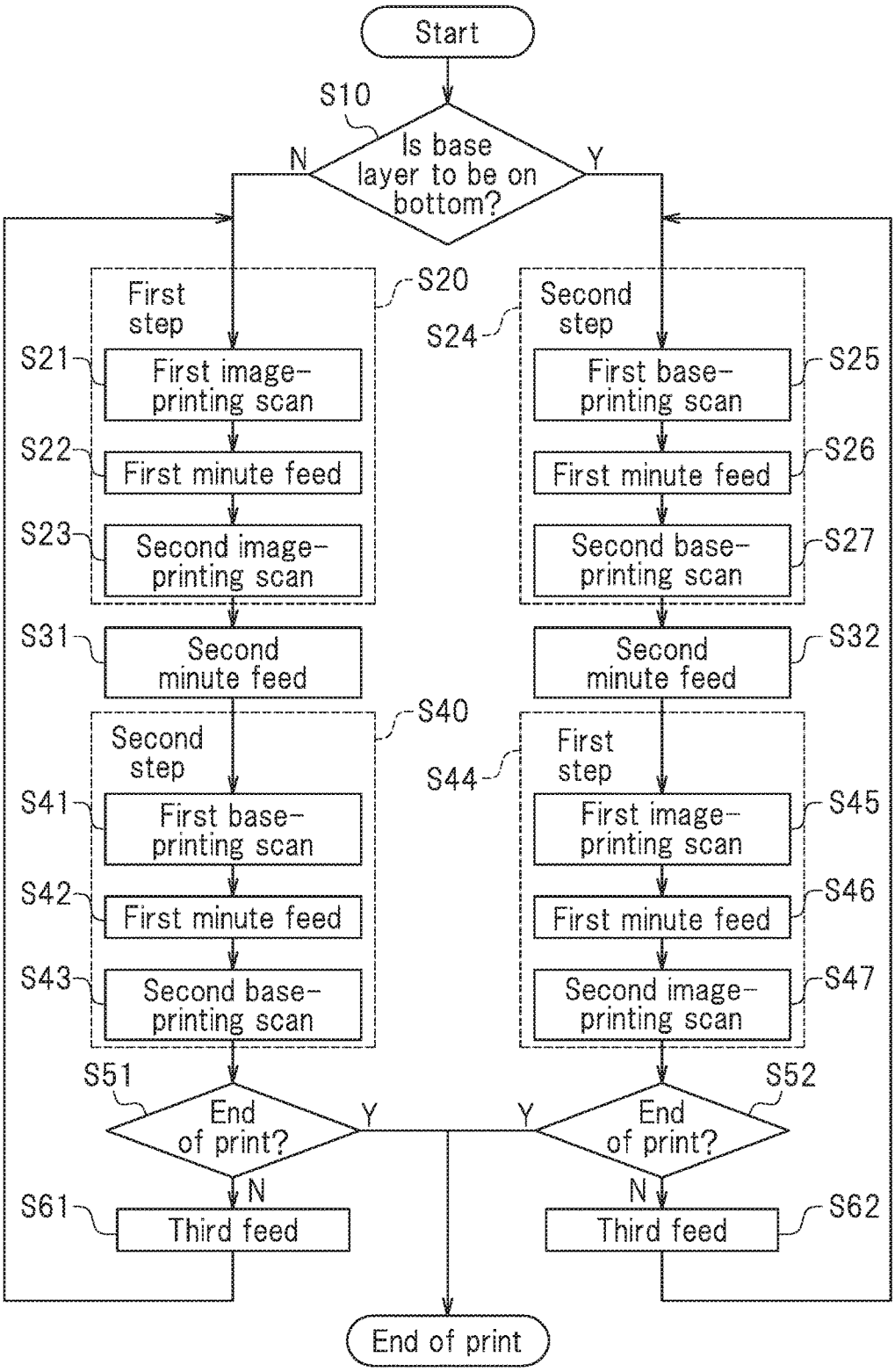
FIG. 4 is a flow chart showing a printing method according to one preferred embodiment of the present invention.

FIG. 4 is a flow chart of a printing method according to a preferred embodiment of the present invention. The printing method essentially includes a first step (S20 or S44) of printing an image layer in a band shape corresponding to the size of the nozzle row of the discharge head 30 in the secondary scan direction, and a second step (S40 or S24) of printing a base layer in substantially the same band shape, by moving the discharge head 30 in the primary scan direction Y. Whether the first step or the second step is performed first (i.e., which layer is printed on the bottom) is determined in step S10 based on print data. That is, in step S10, when the print data indicates that the print process of discharging the base ink is to be performed prior to the print process of discharging the image ink, it is determined that "the base layer is to be on the bottom", and the process proceeds to "Y". On the other hand, when the print process of discharging the base ink is to be performed after the print process of discharging the image ink, it is determined that "the base layer is not to be on the bottom", and the process proceeds to "N". The process of overprinting an image layer of the first step and a base layer of the second step is successively repeated while feeding the recording medium 5 only in the first direction X1 along the secondary scan direction X, thus overprinting an image of a predetermined size (S51, S52). In the following description, an image layer printed in a band shape is referred to as an image band, and a base layer printed in a band shape as a base band. A print result obtained by overprinting an image band and a base band may be referred to as an overprint band. As an exemplary control, how to control the printer 1 when performing an overprint process, in which an image layer is printed on the bottom and a base layer is printed on top as determined in step S10 (i.e., when it is determined in step S10 that "the base layer is not to be on the bottom (N)"), will now be described. FIGS. 5A to 5F are schematic diagrams (plan views) of different printing steps illustrating how a print process is performed by the printer 1.

Figure 5A:
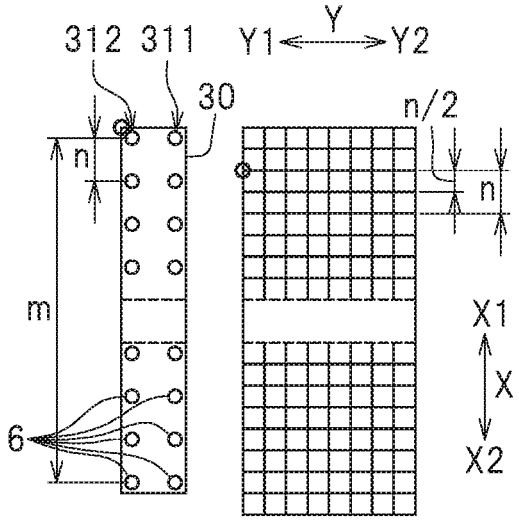
FIG. 5A is a schematic diagram showing how a print process is performed by a printer according to one preferred embodiment of the present invention.

The left side of FIG. 5A schematically shows the discharge head 30. On the lower surface of the discharge head 30, the first nozzle row 311 and the second nozzle row 312 are arranged next to each other in the primary scan direction Y as described above. For example, the first nozzle row 311 and the second nozzle row 312 are each provided with 180 nozzles 6, for example. That is, the first nozzle row 311 and the second nozzle row 312 have the same nozzle resolution. As described above, the first nozzle row 311 and the second nozzle row 312 each have a length "m" in the secondary scan direction X with a nozzle pitch of "n". However, for the purpose of discussion, the figures only show a few nozzles 6 on the front side and on the rear side while omitting nozzles 6 located in a central portion in the secondary scan direction X. The nozzle rows 31C, 31M, 31Y and 31K to discharge image inks are represented as one first nozzle row 311 for the sake of simplicity.

The grid shown on the right side of FIG. 5A next to the discharge head 30 schematically represents a band-shaped print area of the recording medium 5. Although the band-shaped print area is elongated in the primary scan direction Y (e.g., greater than or equal to the width of the A1 size (594 mm)), it is shown to be cut short for the sake of simplicity. In the figures, each square of the grid corresponds to one pixel of print data. That is, the size of each square is determined based on the print resolution of the print data. An intended image, or the like, can be printed by discharging an image ink of a predetermined color in each square according to the print data. In the present preferred embodiment, the resolution in the secondary scan direction of the print data is higher than the resolution (nozzle resolution) in the secondary scan direction of the discharge head 30, and print processes are performed with a print resolution that is higher than the nozzle resolution. In the present preferred embodiment, the print resolution in the secondary scan direction is "twice" the nozzle resolution, for example. That is, the size of one square (representing one pixel) in the primary scan direction Y and that in the secondary scan direction X are less than the nozzle pitch "n". In this example, the size of one square (representing one pixel) in the primary scan direction Y and that in the secondary scan direction X are "n/2", which is one half the nozzle pitch "n". The print resolution of the first nozzle row 311 and the print resolution of the second nozzle row 312 preferably are set to be equal to each other or substantially equal to each other. Note that the circle at the upper-left corner of the discharge head 30 and the circle at the upper-left corner of the print area are shown to make it easier to understand the positional relationship between the discharge head 30 and the print area.

FIGS. 5B to 5F each show a print scan performed by the controllers, and an image printed by the print scan. In FIGS. 5B to 5F, each nozzle 6 represented by an open circle means that ink has not been discharged from that nozzle 6 in the print scan, and each nozzle 6 represented by a hatched circle means that ink has been discharged from that nozzle 6 in the print scan. Each hatched square means that ink has been discharged onto the square. In the present preferred embodiment, each square onto which the base ink has been discharged is represented by hatching with dots (lighter hatching), and each square onto which the image ink has been discharged is represented by hatching with lines (darker hatching). Hereinafter, each ink droplet that has been discharged from the first nozzle row 311 and has landed on the recording medium 5 will be referred to as an image ink dot, and each ink droplet that has been discharged from the second nozzle row 312 and has landed on the recording medium 5 will be referred to as a base ink dot. An image ink dot and a base ink dot are each suitably sized to fill one pixel. When an image ink dot is formed by ink droplets discharged from different nozzles 6 of different colors, the ink droplets are adjusted so that their mark of landing is suitably sized to fill one pixel. In these figures, for the sake of simplicity, squares are hatched, irrespective of the size and the shape of actual ink dots, indicating that a properly-sized ink dot is formed in each of these squares. Image ink dots and base ink dots both include first ink dots formed in the first print scan and second ink dots formed in the second print scan, respectively.

In the present preferred embodiment, an image band is first printed in the first step (S20), after which a second minute feed (S31) is performed, and then a base band is printed (S40) in the second step. These steps are performed with the third controller 43 controlling the first controller 41 and the second controller 42. That is, the third controller 43 first controls the first controller 41 to perform the first step, after which the second minute feed is performed, and then the third controller 43 controls the second controller 42 to perform the second step.

Figure 5B:
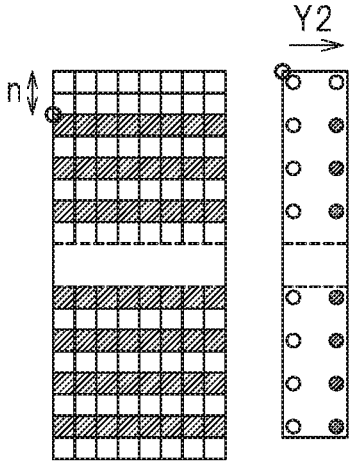
FIG. 5B is a schematic diagram showing how a print process is performed by the printer, subsequent to FIG. 5A.
Figure 5C:
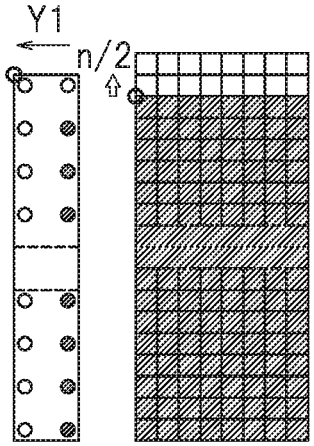
FIG. 5C is a schematic diagram showing how a print process is performed by the printer, subsequent to FIG. 5B.

Specifically, the third controller 43 sends an instruction to the first controller 41 to perform the first step as shown in FIGS. 5B to 5C. In this first step, the first controller 41 controls the feed motor 16, the carriage motor 28 and the actuator 32. The first controller 41 first performs the first image-printing scan (S21) shown in FIG. 5B. That is, the first controller 41 rotates the carriage motor 28 in the forward direction to move the discharge head 30 in the leftward direction Y2 along the primary scan direction Y. That is, the first controller 41 controls the speed of the carriage motor 28 and the actuation of the actuator 32 according to the print data so as to discharge the image ink from the first nozzle row 311 onto the recording medium 5 with predetermined timing based on the print data.

In this example, first image ink dots are formed to be adjacent to each other in the primary scan direction Y. In the secondary scan direction X, the first image ink dots have a dot-to-dot distance (dot pitch) of "n", with an interval of "n/2" between adjacent dots. Thus, the first image ink dots are formed in lines (stripes) extending in the primary scan direction Y. In other words, a plurality of lines of the image each having a width of n/2 (which may hereinafter be referred to as image lines) and extending in the primary scan direction Y can be printed with a pitch of n in the secondary scan direction X. Note that in the first image-printing scan, the first controller 41 performs a control so that the base ink is not discharged from the second nozzle row 312. Moreover, the first controller 41 performs a control so that the image ink is not discharged from a nozzle 6 that is located at the end portion of the first nozzle row 311 in the first direction X1 along the secondary scan direction X, of all the nozzles 6 of the first nozzle row 311.

Next, the first controller 41 performs the first minute feed (S22) shown in FIGS. 5B to 5C. That is, the first controller 41 rotates the feed motor 16 in the forward direction so as to feed the recording medium 5 by a minute distance "n/2" in the first direction X1 (the upward direction in the figure) along the secondary scan direction X. The distance "n/2" is the dimension of one square in the secondary scan direction X. In this example, the distance "n/2" corresponds to the first feed distance. Thus, the nozzles 6 are located between the image lines in the secondary scan direction X. Note that the first feed distance is not limited to the size of one square in the secondary scan direction X, as will be described below.

Then, the first controller 41 successively performs the second image-printing scan (S23) as shown in FIG. 5C. That is, the first controller 41 rotates the carriage motor 28 in the reverse direction so as to move the discharge head 30 in the rightward direction Y1 along the primary scan direction Y. The first controller 41 controls the speed of the carriage motor 28 and the actuation of the actuator 32 according to the print data so as to discharge the second image ink from the first nozzle row 311 onto the recording medium 5 with predetermined timing based on the print data. The first controller 41 performs a control so as to discharge the image ink so that the image ink lands next to the previously-formed first image ink dots in the second direction X2. Thus, second image ink dots are formed next to the first image ink dots in the second direction X2. Note that the second image ink dots also have a dot pitch of "n", with an interval of "n/2" between adjacent dots. Thus, the image ink can be applied onto a band-shaped area having a width of "m" in the secondary scan direction X, which substantially coincides with the length "m" of the nozzle row, and extending in the primary scan direction Y. In other words, an image band can be printed in a predetermined band-shaped print area. Thus, the first step by the first controller 41 is completed.

When the process of printing an image band by the first step (S20) of the first controller 41 described above is completed, the third controller 43 performs the second minute feed (S31).

Figure 5D:
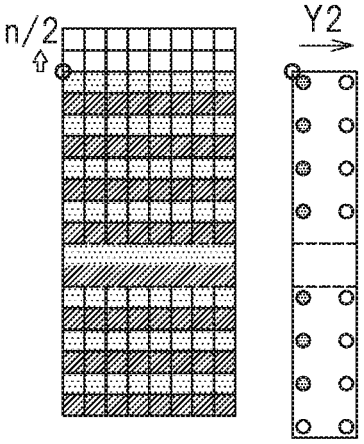
FIG. 5D is a schematic diagram showing how a print process is performed by the printer, subsequent to FIG. 5C.

In the second minute feed, the third controller 43 rotates the feed motor 16 in the forward direction so as to feed the recording medium 5 in the first direction X1 along the secondary scan direction X. Herein, the third controller 43 feeds the recording medium 5 by a minute distance "n/2" that is calculated based on the print resolution in the secondary scan direction X as shown in FIGS. 5C to 5D. "n/2" is the dimension of one square in the secondary scan direction X. In this example, the distance "n/2" corresponds to the second feed distance. Thus, the nozzles 6 of the second nozzle row 312 are located over the already-printed band-shaped image band. A nozzle 6 that is located at the end portion of the second nozzle row 312 in the first direction X1 is located over the end portion of the already-printed band-shape image band in the first direction X1. Then, a nozzle 6 that is located at the end portion of the second nozzle row 312 in the second direction X2 is located outside the already-printed band-shape image band. Note that the second feed distance is not limited to the size of one square in the secondary scan direction X, as will be described below.

Figure 5E:
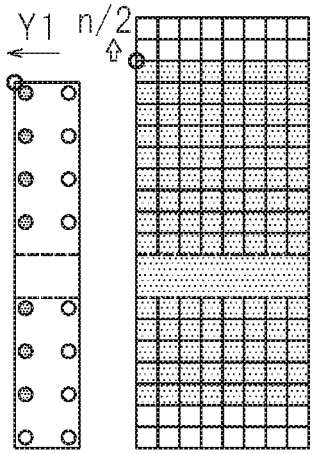
FIG. 5E is a schematic diagram showing how a print process is performed by the printer, subsequent to FIG. 5D.
Figure 5F:
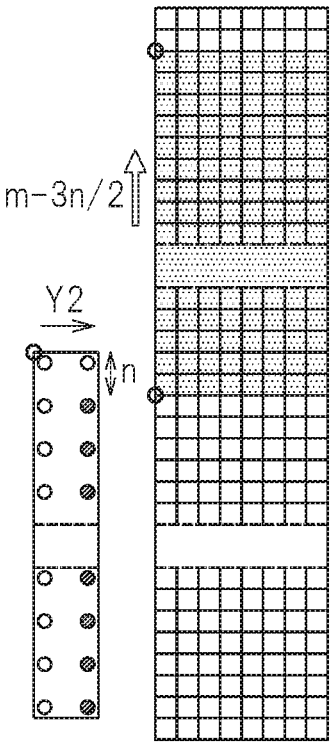
FIG. 5F is a schematic diagram showing how a print process is performed by the printer, subsequent to FIG. 5E.

Next, the third controller 43 controls the second controller 42 so as to perform the process of printing a base band by the second step (S40). The third controller 43 sends an instruction to the second controller 42 to perform the second step as shown in FIGS. 5D to 5E. In this second step, the second controller 42 controls the feed motor 16, the carriage motor 28 and the actuator 34. The second controller 42 first performs the first base-printing scan (S41) shown in FIG. 5D. Specifically, the second controller 42 rotates the carriage motor 28 in the forward direction to move the discharge head 30 in the leftward direction Y2 along the primary scan direction Y. At this point, the second controller 42 controls the speed of the carriage motor 28 and the actuation of the actuator 34 according to the print data so as to discharge the base ink from the second nozzle row 312 onto the recording medium 5 with predetermined timing based on the print data, thus forming first base ink dots. The first iteration of the first base-printing scan is performed as described above.

In this example, the first base ink dots are formed to be adjacent to each other in the primary scan direction Y. In the secondary scan direction X, the first base ink dots have a dot pitch of "n", with an interval of "n/2" between adjacent dots. Thus, the first base ink dots are formed in lines (stripes) extending in the primary scan direction Y on the already-printed image band. In other words, a plurality of lines of the base each having a width of n/2 (which may hereinafter be referred to as base lines) and extending in the primary scan direction Y can be overprinted with a pitch of n in the secondary scan direction X. Note that in this process, the second controller 42 performs a control so that the image ink is not discharged from the first nozzle row 311. Moreover, the second controller 42 performs a control so that the base ink is not discharged from a nozzle 6 that is located at the end portion of the second nozzle row 312 in the second direction X2 along the secondary scan direction X, of all the nozzles 6 of the second nozzle row 312.

Next, the second controller 42 performs the first minute feed (S42) shown in FIGS. 5D to 5E. That is, the second controller 42 rotates the feed motor 16 in the forward direction so as to feed the recording medium 5 by a minute distance "n/2" in the first direction X1 (the upward direction in the figure) along the secondary scan direction X. The particulars of the first minute feed performed by the second controller 42 are substantially the same as the first minute feed of the first controller 41, and the description thereof will not be repeated below.

Then, the second controller 42 successively performs the second base-printing scan (S43) as shown in FIG. 5E. That is, the second controller 42 rotates the carriage motor 28 in the reverse direction so as to move the discharge head 30 in the rightward direction Y1 along the primary scan direction Y. The second controller 42 controls the speed of the carriage motor 28 and the actuation of the actuator 34 according to the print data so as to discharge the base ink from the second nozzle row 312 onto the recording medium 5 with predetermined timing based on the print data. The second controller 42 performs a control so as to discharge the base ink so that the base ink lands next to the previously-formed first base ink dots in the second direction X2. Thus, the second base ink dots are formed next to the first base ink dots in the second direction X2. The first iteration of the second base-printing scan is performed as described above. Note that the second base ink dots have a dot pitch of "n", with an interval of "n/2" between adjacent dots. Thus, the base ink can be applied, over the image band, onto a band-shape area having a width of "m" in the secondary scan direction X, which substantially coincides with the length "m" of the nozzle row, and extending in the primary scan direction Y. In other words, a predetermined band-shaped base band can be printed on a predetermined band-shaped image band. Thus, the second step by the second controller 42 is completed. An overprint band is able to be printed as described above.

With the configuration described above, the first minute feed (S22, S42) and the second minute feed (S31), which are steps of feeding the recording medium 5, both feed the recording medium 5 in the first direction X1 along the secondary scan direction X. Thus, it is possible to perform an overprint process by feeding only in one direction. In the overprint process described above, feeding in the first direction X1 is realized by performing a plurality of (e.g., two) iterations of a print process over a width (e.g., n/2) smaller than the nozzle pitch "n". Thus, it is possible to perform an overprint process with a print resolution that is higher than the nozzle resolution. In the overprint process described above, only one nozzle 6 that is located at the end portion of the first nozzle row 311 in the first direction X1 and only one nozzle 6 that is located at the end portion of the second nozzle row in the second direction X2 are not used, while using all the other nozzles 6 located in a central portion. Thus, even when an overprint process is performed over a long time, clogging and discharge failure of nozzles that are not used in the overprint process are significantly reduced or prevented. The discharge head 30 is moved in the primary scan direction Y for two print scans (i.e., one reciprocation) to print an image band, and for two print scans (i.e., one reciprocation) for printing a base band. Thus, with the technique disclosed herein, since an image band is printed in two print scans, it is possible to ensure a longer dry time until a base band is printed over the image band, as compared with a case in which an image band is printed in one print scan. Therefore, it is possible to reduce the color mixing between the image ink and the base ink.

After printing an overprint band, the controller 40 determines, in step S51, whether or not the overprint process has been completed based on the print data. When it is determined that the overprint process has been completed ("Y" in S51), the controller 40 ends the print process and sends the discharge head 30 to the home position HP where the discharge head 30 stands by. On the other hand, when it is determined that the overprint process has not been completed ("N" in S51), the fourth controller 44 controls the first controller 41, the second controller 42 and the third controller 43 so as to successively repeat the band-shaped overprint described above in the secondary scan direction X. Specifically, when it is determined that the overprint process has not been completed, the fourth controller 44 performs the third feed shown in FIGS. 5E to 5F (S61). The fourth controller 44 rotates the feed motor 16 in the forward direction so as to feed the recording medium 5 by a distance "m−3×(n/2)" in the first direction X1 along the secondary scan direction X. The distance "m−3×(n/2)" is the length "m" of the nozzle row minus the distance "3×(n/2)" by which the recording medium 5 has been fed in the first direction X1 while printing the overprint band. In this example, the distance "m−3×(n/2)" corresponds to the third feed distance. After such a third feed, the discharge head 30 and the next print area are in a positional relationship shown in FIG. 5F. This is equal to the initial positional relationship between the discharge head 30 and the print area shown in FIG. 5A. By successively repeating the first step (S20), the second minute feed (S31) and the second step (S40) shown in FIGS. 5B to 5E with the third feed (S61) interposed therebetween, it is possible to perform an overprint process of a predetermined size in the secondary scan direction X.

With the configuration described above, an overprint process of a width corresponding to the length of the nozzle row is able to be repeatedly performed while the recording medium feeding direction remains the first direction. Thus, it is possible to perform a process of overprinting an image having an intended size.

Moreover, with the configuration described above, the first controller 41 performs the first step (S20) in two print scans, i.e., the first image-printing scan (S21) and the second image-printing scan (S23). In other words, an image band is printed, with twice the print resolution, in two print scans. However, an image band may be printed in three or more print scans. That is, it is possible to further increase the print resolution in the secondary scan direction X of the print data of the image layer. In this case, in the first step (S20), the first minute feed (S22) and the second image-printing scan (S23) can be repeated after the second image-printing scan (S23), for example. In this case, in the second or subsequent iteration of the second image-printing scan, second image ink dots formed in a $(Z-1)^{th}$ iteration of the second image-printing scan may be regarded as first image ink dots, and in the $Z^{th}$ iteration of the second image print process, second image ink dots may be formed next to the first image ink dots (herein, z is an integer of two or more). Then, the first feed distance can be represented as "n/a", for example, where "a" is the number of print scans in the secondary scan direction X performed in the first step (in other words, the number of times the recording medium is fed in the secondary scan direction X in the first step plus 1). Note however that "a" is an integer of two or more. While there is no particular limitation on the number of times "a" of print scans, it is typically an integer of two or more and five or less, and is preferably two or three, for example. Specifically, when an image band is printed in three print scans in the secondary scan direction X, the first feed distance can be set to "n/3". Accordingly, the amount of the image ink to be discharged from the first nozzle row 311 and the size of the first image ink dot and the second image ink dot are adjusted suitably in accordance with the print resolution.

Similarly, the second controller 42 performs the second step (S40) in two print scans, i.e., the first base-printing scan (S41) and the second base-printing scan (S43). In other words, a base band is printed in two print scans. However, a base band may be printed in three or more print scans. That is, it is possible to further increase the print resolution in the secondary scan direction X of the print data of the base layer. In this case, in the second step (S40), the first minute feed (S42) and the second base-printing scan (S43) can be repeated after the second base-printing scan (S43), for example. In the second or subsequent iteration of the second base-printing scan, as with the second or subsequent iteration of the second image-printing scan described above, second base ink dots formed in the preceding iteration of the second base-printing scan may be regarded as first base ink dots, and second base ink dots may be formed next to the first base ink dots. Then, the first feed distance can be represented as "n/a'", for example, where "a'" is the number of print scans in the secondary scan direction X performed in the second step (in other words, the number of times the recording medium is fed in the secondary scan direction X in the second step plus 1). Note however that "a'" is an integer of two or more. While there is no particular limitation on the number of times "a'" of print scans, it is typically an integer of two or more and five or less, and is preferably two or three, for example. Specifically, when an image band is printed in three print scans in the secondary scan direction X, the first feed distance can be set to "n/3". Accordingly, the amount of the base ink to be discharged from the second nozzle row 312 and the size of the first base ink dot and the second base ink dot are adjusted suitably in accordance with the print resolution. The number of times "a" of print scans in the secondary scan direction X performed in the first step and the number of times "a'" of print scans in the secondary scan direction X performed in the second step may be equal to or different from each other.

With the configuration described above, the first controller 41 performs the first image-printing scan (S21) and the second image-printing scan (S23) in one print scan. In other words, an image line is printed in one print scan. However, an image line may be printed in two or more print scans. That is, it is possible to increase the print resolution in the primary scan direction Y of the print data of the image layer. In this case, the actuation of the actuator 32 is controlled by the first controller 41 so as to reduce the amount of the image ink to be discharged from the first nozzle row 311. Also, the speed of the carriage motor 28 is increased by the first controller 41, thus increasing the moving speed of the discharge head 30 in the primary scan direction Y. Then, for example, first image ink dots can be formed in a decimated manner in the first iteration of the first image-printing scan (S21). Therefore, by performing the second iteration of the first image-printing scan (S21) by discharging the image ink from the first nozzles 6 while moving the discharge head 30 in the primary scan direction Y again without feeding the recording medium 5 in the secondary scan direction X, it is possible to newly form first image ink dots next to the already-formed first image ink dots in the primary scan direction Y. The first image-printing scan (S21) can be repeated until the first image ink dots all connect together to form a complete image line extending in the primary scan direction Y. Thus, by performing two or more iterations of the first image-printing scan (S21), it is possible to print an image line with a higher resolution. Similarly, by performing two or more iterations of the second image-printing scan (S23), it is possible to print an image line with a higher resolution. As a result, it is possible to print an image band with a higher definition.

Similarly, with the configuration described above, the second controller 42 performs the first base-printing scan (S41) and the second base-printing scan (S43) in one print scan. In other words, a base line is printed in one print scan. However, also a base line, as with an image line described above, may be printed in two or more print scans. That is, it is possible to increase the print resolution in the primary scan direction Y of the print data of the base layer. In this case, the actuation of the actuator 34 is controlled by the second controller 42 so as to reduce the amount of the image ink to be discharged from the second nozzle row 312. Also, the speed of the carriage motor 28 is increased by the second controller 42, thus increasing the moving speed of the discharge head 30 in the primary scan direction Y. Then, for example, first base ink dots can be formed in a decimated manner in the first iteration of the first base-printing scan (S41). Therefore, by performing the second iteration of the first base-printing scan (S41) by discharging the base ink from the second nozzles 6 while moving the discharge head 30 in the primary scan direction Y again without feeding the recording medium 5 in the secondary scan direction X, it is possible to newly form first base ink dots next to the already-formed first base ink dots in the primary scan direction Y. The first base-printing scan (S41) can be repeated until first base ink dots all connect together to form a complete base line extending in the primary scan direction Y. Thus, by performing two or more iterations of the first base-printing scan (S41), it is possible to print a base line with a higher resolution. Similarly, by performing two or more iterations of the second base-printing scan (S43), it is possible to print a base line with a higher resolution. As a result, it is possible to print a base band with a higher definition.

Note that as an additional preferred embodiment of the present invention, the controller 40 may include a discharge amount controller (not shown), for example. The discharge amount controller is capable of calculating the amount of ink to be discharged from each nozzle 6 of the first nozzle row 311 and each nozzle 6 of the second nozzle row 312 independently of each other based on the print data, the print resolution, etc. The discharge amount controller may be configured or programmed to send an instruction to the first controller 41 and the second controller 42 so that a calculated amount of ink is discharged from each nozzle 6 of the first nozzle row 311 and each nozzle 6 of the second nozzle row 312. Alternatively, the first controller 41 and the second controller 42 may refer to the ink discharge amount calculated by the discharge amount controller so that a calculated amount of ink is discharged from each nozzle 6.

As described above, according to the techniques disclosed herein, for example, the print resolution of the image band and the base band for the primary scan direction Y do not need to be equal to that for the secondary scan direction X. Moreover, for example, the print resolution of the image band and the base band may be determined arbitrarily for the primary scan direction Y and for the secondary scan direction X independently of each other.

Second Preferred Embodiment

The first preferred embodiment described above is directed to a case in which an image layer is printed on the bottom, and a base layer is printed on the image layer. The technique disclosed herein is not limited to the first preferred embodiment above. For example, in step S10 of FIG. 4, if it is determined that "the base layer is to be printed on the bottom (Y)" based on the print data, an overprint process is performed in which the base layer is printed on the bottom and the image layer is printed thereon. In this case, as shown in the right half of the flow chart of FIG. 4 and in FIGS. 6A to 6F, first, a base band is printed by the second step (S24), and then the image band is printed by the first step (S44) with the second minute feed (S32) interposed therebetween. These steps are performed with the third controller 43 controlling the first controller 41 and the second controller 42. That is, the third controller 43 first controls the second controller 42 to perform the second step, after which the first minute feed is performed, and then the third controller 43 controls the first controller 41 to perform the first step.

Figure 6A:
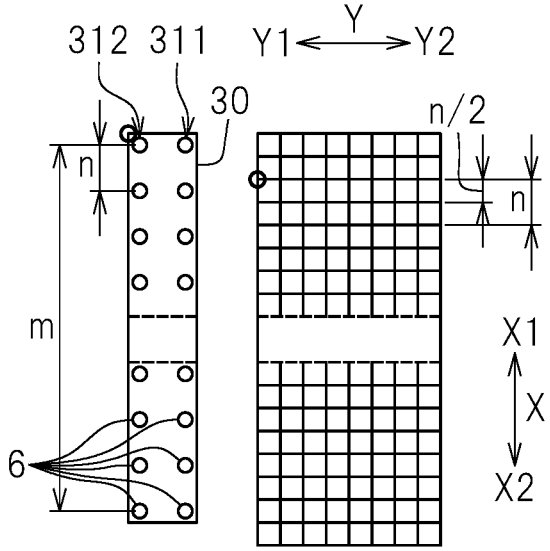
FIG. 6A is a schematic diagram showing how a print process is performed by a printer according to another preferred embodiment of the present invention.
Figure 6B:
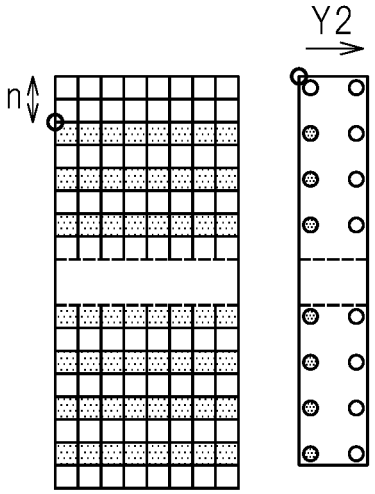
FIG. 6B is a schematic diagram showing how a print process is performed by the printer, subsequent to FIG. 6A.
Figure 6C:
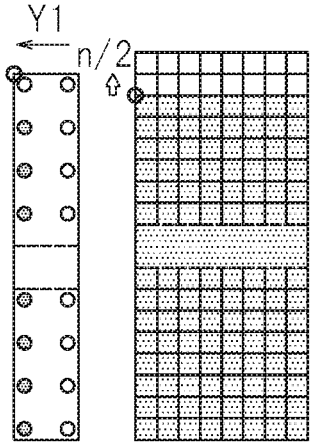
FIG. 6C is a schematic diagram showing how a print process is performed by the printer, subsequent to FIG. 6B.

Specifically, first, the third controller 43 controls the second controller 42 to perform the second step (S24) as shown in FIG. 6B. The second controller 42 controls the speed of the carriage motor 28 and the actuation of the actuator 34 according to the print data so as to discharge first base ink dots from the second nozzle row 312 onto the recording medium 5 with predetermined timing based on the print data. In this process, the discharge head 30 discharges first base ink dots while moving in the leftward direction Y2. The first iteration of the first base-printing scan is performed as described above (S25). Then, as shown in FIGS. 6B to 6C, the second controller 42 performs the first minute feed (S26). Specifically, the second controller 42 rotates the feed motor 16 in the forward direction so as to feed the recording medium 5 by a distance "n/2" in the first direction X1 along the secondary scan direction X. Then, the third controller 43 controls the second controller 42 to perform the second base-printing scan (S27) as shown in FIG. 6C. Specifically, the second controller 42 controls the speed of the carriage motor 28 and the actuation of the actuator 34 according to the print data so as to perform the first iteration of the second base-printing scan (S27) in the rightward direction Y1. Note that in the second step, the second controller 42 performs a control so that the image ink is not discharged from the first nozzle row 311. The second controller 42 performs a control so that the base ink is not discharged from a nozzle 6 that is located at the end portion of the second nozzle row 312 in the second direction X1 along the secondary scan direction X, of all the nozzles 6 of the second nozzle row 312. Thus, a base band can be printed. The particulars of the control of the second controller 42 are substantially the same as the first preferred embodiment shown in FIGS. 5B to 5C, and the description thereof will not be repeated below (this similarly applies hereinbelow).

Figure 6D:
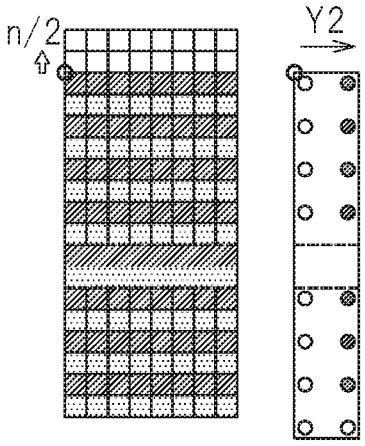
FIG. 6D is a schematic diagram showing how a print process is performed by the printer, subsequent to FIG. 6C.

Next, as shown in FIGS. 6C to 6D, the second minute feed is performed (S32). Specifically, the third controller 43 rotates the feed motor 16 in the forward direction so as to feed the recording medium 5 by a second feed distance "n/2" in the first direction X1 along the secondary scan direction X. Thus, the nozzles 6 of the first nozzle row 311 are located over the already-printed band-shape base band. A nozzle 6 that is located at the end portion of the first nozzle row 311 in the first direction X1 is located over the end portion of the already-printed band-shape base band in the first direction X1. A nozzle 6 that is located at the end portion of the first nozzle row 311 in the second direction X2 is located outside the already-printed band-shape base band.

Figure 6E:
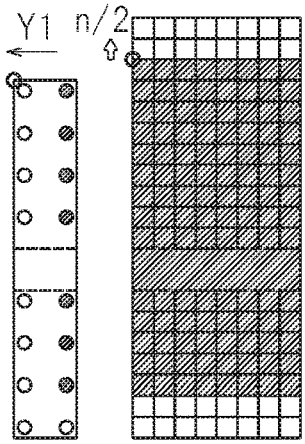
FIG. 6E is a schematic diagram showing how a print process is performed by the printer, subsequent to FIG. 6D.

Then, the third controller 43 controls the first controller 41 to perform the first step (S44) as shown in FIGS. 6D to 6E. Specifically, first, the first controller 41 controls the speed of the carriage motor 28 and the actuation of the actuator 32 according to the print data so as to perform the first iteration of the first image-printing scan (S45) in the leftward direction Y2 as shown in FIG. 6D. Then, the first controller 41 performs the first minute feed (S46) as shown in FIGS. 6D to 6E. Specifically, the first controller 41 rotates the feed motor 16 in the forward direction so as to feed the recording medium 5 by a distance "n/2" in the first direction X1 along the secondary scan direction X. Then, the first controller 41 performs the first iteration of the second image-printing scan (S47) in the rightward direction Y1 as shown in FIG. 6B(d). Note that in the first step, the first controller 41 performs a control so that the base ink is not discharged from the second nozzle row 312. The first controller 41 performs a control so that the image ink is not discharged from a nozzle 6 that is located at the end portion of the first nozzle row 311 in the second direction X2 along the secondary scan direction X, of all the nozzles 6 of the first nozzle row 311. An image band can be printed by the first step as described above. As a result, it is possible to print an overprint band.

Figure 6F:
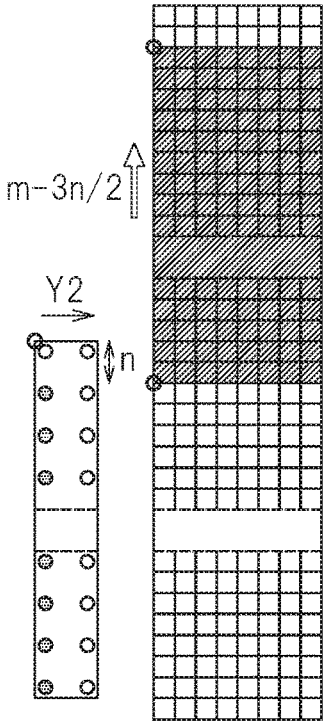
FIG. 6F is a schematic diagram showing how a print process is performed by the printer, subsequent to FIG. 6E.

Then, the controller 40 determines, in step S52, whether or not the overprint process has been completed based on the print data. When it is determined that the overprint process has been completed ("Y" in S52), the controller 40 ends the print process and sends the discharge head 30 to the home position HP where the discharge head 30 stands by. On the other hand, when it is determined that the overprint process has not been completed ("N" in S52), the print process continues based on the print data. Then, the fourth controller 44 performs the third feed (S62) as shown in FIGS. 6E to 6F. That is, the fourth controller 44 rotates the feed motor 16 in the forward direction so as to feed the recording medium 5 by a distance "m−3×(n/2)" in the first direction X1 along the secondary scan direction X. After such a third feed, the discharge head 30 and the next print area are in a positional relationship shown in FIG. 6F. This is equal to the initial positional relationship between the discharge head 30 and the print area shown in FIG. 6A. By successively repeating the second step (S24), the second minute feed (S32) and the first step (S44) shown in FIGS. 6B to 6C with the third feed (S62) interposed therebetween, it is possible to perform an overprint process of a predetermined size in the secondary scan direction X. By performing all the print process based on the print data as described above, the print process is able to be completed (S52).

Third Preferred Embodiment

With the first and second preferred embodiments described above, the first feed distance preferably is set to "n/2" in the first minute feed when printing an image band and a base band so that an image line and a base line adjacent to each other are printed by the same nozzles 6, for example. When clogging or discharge failure occurs to any of the nozzles 6 of the first nozzle row 311 and the second nozzle row 312, an image line or a base line printed by the nozzle 6 may have a print defect such as fading or a missing portion. In such a case, if adjacent print lines are printed by the same nozzles 6, image lines or base lines including a print defect are printed to be adjacent to each other, and the print defect may become conspicuous. Therefore, according to the technique disclosed herein, the first feed distance preferably is set to be greater than "n/2", and even if clogging or discharge failure occurs to any of the nozzles 6 of the first nozzle row 311 and the second nozzle row 312, the print process is able to be performed so that print lines including a print defect are not printed adjacent to each other. For example, the first feed distance can be set to a length corresponding to "n/a+b×n" where "n" denotes the nozzle pitch. Herein, "a" is an integer of two or more, and corresponds to the number of times the recording medium is fed in the secondary scan direction X while printing an image band as described above. The first feed distance can be set to a length corresponding to "n/a'+b×n" where "n" denotes the nozzle pitch. Herein, "a'" is an integer of two or more, and corresponds to the number of times the recording medium is fed in the secondary scan direction X while printing a base band as described above. Moreover, "b" is an integer of zero or more, and corresponds to the interval (line pitch) "b×n" between centers of print lines printed by one nozzle 6.

A method for printing a print line by the same nozzle 6 in a decimated manner will now be described, for a case in which a=2 and b=1, as shown in FIGS. 7A to 7D and FIG. 8. The following description is directed to an example of an overprint process when it is determined in step S10 of FIG. 4 that "the base layer is to be printed on the bottom (Y)" based on the print data, as in the second preferred embodiment described above. In this case, first, a base band is printed by the second step (S24), and then an image band is printed by the first step (S44), with the second minute feed (S32) interposed therebetween.

Figure 7A:
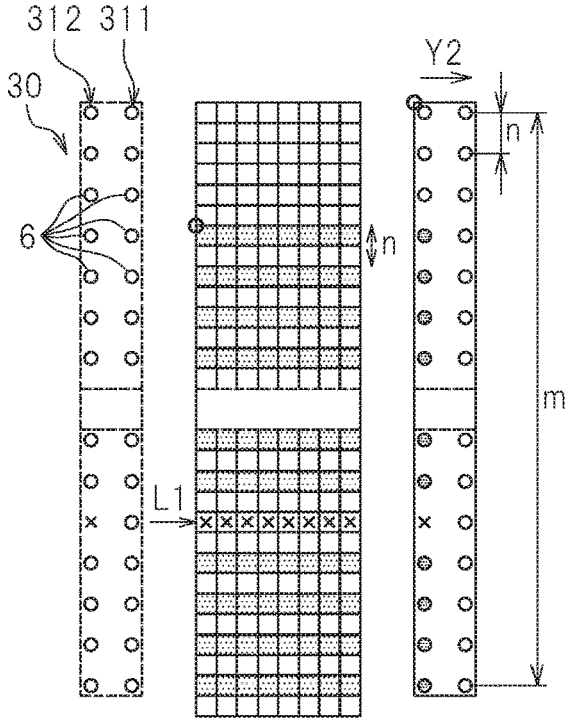
FIG. 7A is a schematic diagram showing how a print process is performed by a printer according to still another preferred embodiment of the present invention.

The third controller 43 first instructs the second controller 42 to perform the second step (S24). Specifically, the first base-printing scan (S25) is performed as shown in FIG. 7A. In this process, the second controller 42 performs a control so that the base ink is not discharged from three nozzles 6 that are located at the end portion of the second nozzle row 312 in the first direction X1 along the secondary scan direction X. Moreover, one of the nozzles 6 of the second nozzle row 312 that is denoted as "×" is clogged. As a result, the base ink is not discharged from the clogged nozzle 6, and first base ink dots are not formed on the line (L1) that is scanned by this nozzle 6.

Figure 7B:
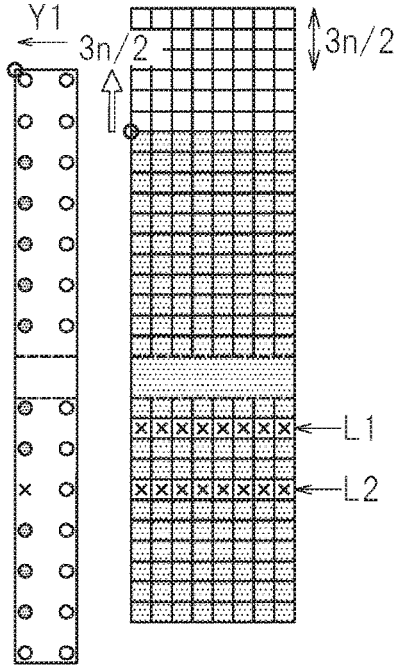
FIG. 7B is a schematic diagram showing how a print process is performed by the printer, subsequent to FIG. 7A.

Then, as shown in FIGS. 7A to 7B, the third controller 43 performs the first minute feed (S26) with a first feed distance "3n/2". That is, the recording medium 5 is fed by a distance "3n/2" in the first direction X1 along the secondary scan direction X. Then, the third controller 43 instructs the second controller 42 to perform the second base-printing scan (S27) as shown in FIG. 7B. In this process, the second controller 42 performs a control so that the base ink is not discharged from two nozzles 6 that are located at the end portion of the second nozzle row 312 in the first direction X1 along the secondary scan direction X and a nozzle 6 that is located at the end portion in the second direction X2. Moreover, one of the nozzles 6 of the second nozzle row 312 that is denoted as "×" is clogged. As a result, the base ink is not discharged from the clogged nozzle 6, and second base ink dots are not formed on the line (L2) that is scanned by this nozzle 6. A base band is printed as described above.

Figure 8:
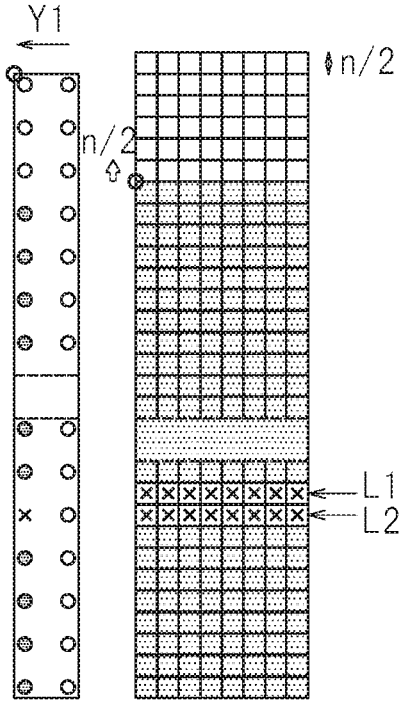
FIG. 8 is a schematic diagram showing another example of how a print process is performed by the printer, subsequent to FIG. 7A.

In this base band, however, base lines are not printed on the lines L1 and L2 that are scanned by the clogged nozzle 6, thus producing "missing lines". The missing lines on the lines L1 and L2 each form a non-printed portion having a width of "n/2". FIG. 8 schematically shows a base band that is printed in a manner similar to that described above except that the first feed distance is set to "n/2". In this case, as shown in FIG. 8, the line pitch between the lines L1 and L2 that are scanned by the clogged nozzle 6 is "n/2", and these lines L1 and L2 are located adjacent to each other. That is, the two missing lines are located adjacent to each other. As a result, the adjacent lines L1 and L2 together form a thicker missing line having a width of "n". Such a thick missing line is more likely to be perceived, and can therefore lower the print quality. Therefore, by setting the first feed distance to be greater than "n/2" (as shown in FIG. 8), even if missing lines occur, it is possible to disperse the missing lines and thus to reduce or prevent the lowering of the print quality.

Figure 7C:
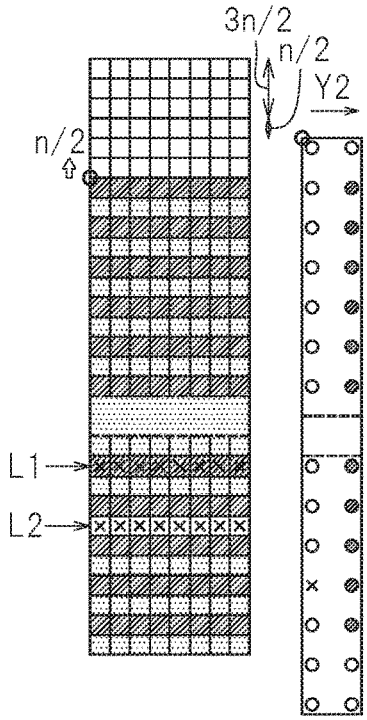
FIG. 7C is a schematic diagram showing how a print process is performed by the printer, subsequent to FIG. 7B.

Note that even when the first feed distance is set to "3n/2", the second minute feed (S32) is able to be performed as shown in FIGS. 7A to 7C. In the second minute feed, the third controller 43 feeds the recording medium 5 by a second feed distance "n/2" in the first direction X1 along the secondary scan direction X. Thus, the nozzles 6 of the first nozzle row 311 are located over the already-printed band-shape base band. At this point, the second nozzle 6 from the end portion of the first nozzle row 311 in the first direction X1 is located over the end portion of the already-printed band-shape base band in the first direction X1. Then, two nozzles 6 that are located at the end portion of the first nozzle row 311 in the second direction X2 are located outside the already-printed band-shape base band. Thus, by reducing the second feed distance to "n/2", it is possible to reduce the number of nozzles 6 of the first nozzle row 311 that are not used for printing.

Figure 7D:
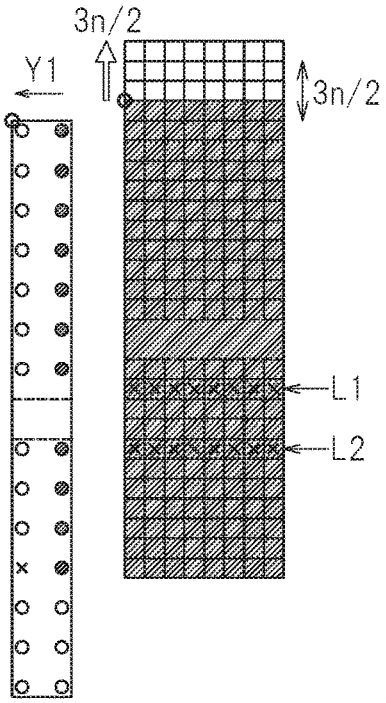
FIG. 7D is a schematic diagram showing how a print process is performed by the printer, subsequent to FIG. 7C.

Then, the third controller 43 instructs the first controller 41 to perform the first step (S44). Specifically, the first image-printing scan (S45) is performed as shown in FIG. 7C. In this process, the first controller 41 performs a control so that the image ink is not discharged from a nozzle 6 that is located at the end portion of the first nozzle row 311 in the first direction X1 along the secondary scan direction X and two nozzles 6 that are located at the end portion in the second direction X2. Then, as shown in FIGS. 7C to 7D, the first controller 41 performs the first minute feed (S46) with a first feed distance "3n/2". That is, the recording medium 5 is fed by a distance "3n/2" in the first direction X1 along the secondary scan direction X. Then, the third controller 43 instructs the first controller 41 to perform the second image-printing scan (S47) as shown in FIG. 7D. In this process, the first controller 41 performs a control so that the image ink is not discharged from three nozzles 6 that are located at the end portion of the first nozzle row 311 in the second direction X2 along the secondary scan direction X. An image band is able to be printed by the first step as described above. As a result, it is possible to print an overprint band. Note that the width of the overprint band that is printed in this example when the first feed distance is set to "3n/2" is represented as "m−2n".

Then, the controller 40 determines, in step S52, whether or not the overprint process has been completed based on the print data. When it is determined that the overprint process has been completed ("Y" in S52), the controller 40 ends the print process and sends the discharge head 30 to the home position HP where the discharge head 30 stands by. On the other hand, when it is determined that the overprint process has not been completed ("N" in S52), the print process continues based on the print data. Then, the fourth controller 44 feeds the recording medium 5 by a distance "m−11n/2"

in the first direction X1 along the secondary scan direction X. After such a third feed, the discharge head 30 and the next print area are in a positional relationship shown in FIG. 7A. This is equal to the initial positional relationship between the discharge head 30 and the print area. By successively repeating the second step (S24), the first minute feed (S32) and the first step (S44) shown in FIGS. 7A to 7D with the third feed (S62) interposed therebetween, it is possible to perform an overprint process of a predetermined size in the secondary scan direction X. By performing all the print process based on the print data as described above, the print process is able to be completed (S52).

Note that with the overprint process described above, the amount of time between when a base band is printed and when an image band is printed may possibly be insufficient depending on the properties of the ink to be used. If the image ink is discharged for printing an image band before the base ink discharged to print a base band dries, the color of the base ink and the color of the image ink get mixed together. Therefore, the printer 1 disclosed herein may include a heater to heat the recording medium. Although not shown specifically, the heater may be installed, for example, on a surface of the platen 12 that is opposite from the surface on which the recording medium 5 is placed (i.e., the surface on the inner side of the printer main body 10). Thus, it is possible to heat the recording medium 5 before or after a print process so as to dry the ink discharged onto the recording medium 5 in a shorter amount of time. Therefore, for example, the base ink discharged onto the recording medium 5 to print the base band can be dried before the image ink is discharged to print the image band over the base band, and it is possible to reduce the mixing between the color of the base ink and the color of the image ink. Note that where the heater is installed is not limited to the reverse side of the platen 12. For example, the discharge head 30 may include a heater 36 (see FIG. 1) on the lower surface thereof. The heater 36 is connected to the controller 40. The heater is controlled by the controller 40. There is no particular limitation on the configuration, the heating mechanism, etc., of the heater. For example, the heater may be any of various heaters that can promote drying of the ink discharged onto the recording medium 5 with or without contact with the ink. Examples of the heater include heating an infrared heater, an element heater and a laser heater, for example. The heater of the present preferred embodiment preferably is an infrared heater, for example. Therefore, it is possible to perform the overprint process described above within a short period of time while preventing the mixing between the color of the base ink and the color of the image ink. Note that needless to say, heating by using a heater can also be used in the first preferred embodiment, the second preferred embodiment, etc.

With the configuration of the preferred embodiment described above, the discharge head 30 moves in the primary scan direction Y and the recording medium 5 moves in the secondary scan direction X. However, the movement of the discharge head 30 and that of the recording medium 5 are not limited thereto as long as the discharge head 30 and the recording medium 5 can move relative to each other. While the first nozzle row 311 and the second nozzle row 312 are provided on the same discharge head 30, the technique disclosed herein is not limited thereto. For example, the printer 1 may include a plurality of discharge heads 30, with the first nozzle row 311 and the second nozzle row 312 being provided on different discharge heads 30.

The preferred embodiments described above are directed to examples in which a process color ink is used as the image ink and a white ink as the base ink. The base ink is an ink that is applied across the entire surface of the area where an image is printed with the image ink. In other words, the base ink is a solid fill ink. As described above, the base layer printed with the base ink can be printed over or under the image layer. That is, the base ink may be a pre-application (pre-print) ink or may be a post-application (post-print) ink. In view of this, with the inkjet printer and the printing method disclosed herein, the "base ink" may be an ink containing a colorant such as a white ink or may be a non-coloring ink that contains no colorant such as a clear ink. That is, the technique disclosed herein can be applied to overprinting using any ink. When a clear ink is used as the "base ink" (or instead of the "base ink"), it is possible to give a unique texture such as a luster to the image layer that has been printed with the image ink or to give the function of protecting the image layer.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer comprising:

a discharge head including a first nozzle row and a second nozzle row, the first nozzle row including a plurality of first nozzles arranged next to each other in a secondary scan direction to discharge an image ink onto a recording medium, the second nozzle row including a plurality of second nozzles arranged next to each other in the secondary scan direction to discharge a base ink onto the recording medium, the first nozzle row and the second nozzle row being arranged next to each other in a primary scan direction that crosses the secondary scan direction;

a scanner that moves the discharge head in the primary scan direction;

a feeder that moves at least one of the recording medium and the discharge head so as to feed the recording medium in the secondary scan direction relative to the discharge head; and a controller that controls the discharge head, the scanner and the feeder; wherein a length and a nozzle pitch of the first nozzle row in the secondary scan direction are equal or substantially equal to a length and a nozzle pitch of the second nozzle row in the secondary scan direction; and the controller includes:

a first controller that performs at least a first image-printing scan of discharging the image ink from the first nozzles while moving the discharge head in the primary scan direction so as to form first image ink dots in a predetermined area of the recording medium, a first minute feed of feeding the recording medium by a first feed distance in a first direction along the secondary scan direction relative to the discharge head, and a second image-printing scan of discharging the image ink from the first nozzles while moving the discharge head in the primary scan direction so as to form second image ink dots in the predetermined area of the recording medium and next to the first image ink dots in the secondary scan direction;

a second controller that performs at least a first base-printing scan of discharging the base ink from the second nozzles while moving the discharge head in the primary scan direction so as to form first base ink dots in the predetermined area of the recording medium, the first minute feed, and a second base-printing scan of discharging the base ink from the second nozzles while moving the discharge head in the primary scan direction so as to form second base ink dots in the predetermined area of the recording medium and next to the first base ink dots in the secondary scan direction; and a third controller that:

instructs the first controller to perform the first image-printing scan, the first minute feed and the second image-printing scan without discharging the image ink from a first nozzle that is located at an end portion of the first nozzle row in the first direction other than a central portion of the first nozzle row in the secondary scan direction; then performs a second minute feed of feeding the recording medium by a second feed distance in the first direction along the secondary scan direction relative to the discharge head; and then instructs the second controller to perform the first base-printing scan, the first minute feed and the second base-printing scan without discharging the base ink from a second nozzle that is located at an end portion of the second nozzle row in a second direction opposite to the first direction other than a central portion of the second nozzle row in the secondary scan direction; or instructs the second controller to perform the first base-printing scan, the first minute feed and the second base-printing scan without discharging the base ink from a second nozzle that is located at an end portion of the second nozzle row in the first direction other than the central portion of the second nozzle row in the secondary scan direction; then performs the second minute feed of feeding the recording medium by the second feed distance in the first direction along the secondary scan direction relative to the discharge head; and then instructs the first controller to perform the first image-printing scan, the first minute feed and the second image-printing scan without discharging the image ink from a first nozzle that is located at an end portion of the first nozzle row in the second direction other than the central portion of the first nozzle row in the secondary scan direction.

2. The inkjet printer according to claim 1, wherein:

the first feed distance is less than about ¼ of the length of first and second nozzle rows in the secondary scan direction; and the central portion of the first and second nozzle rows is a portion that at least excludes opposite end portions thereof in the secondary scan direction, the opposite end portions each having a length corresponding to about twice the first feed distance.

3. The inkjet printer according to claim 1, wherein the third controller instructs:

one of the first controller and the second controller that is to perform a print process first not to discharge ink from at least one nozzle of the nozzle row that is located at an end portion of the nozzle row in the first direction along the secondary scan direction, the end portion having a length corresponding to about twice the first feed distance; and one of the first controller and the second controller that is to perform a print process later not to discharge ink from at least one nozzle of the nozzle row that is located at an end portion of the nozzle row in the second direction, opposite to the first direction, along the secondary scan direction, the end portion having a length corresponding to about twice the first feed distance.

4. The inkjet printer according to claim 1, wherein the first controller:

in the first image-printing scan, discharges the image ink from the first nozzles while moving the discharge head in the primary scan direction so as to form the first image ink dots and then again discharges the image ink from the first nozzles while moving the discharge head in the primary scan direction so as to form other first image ink dots in the predetermined area of the recording medium and next to the already-formed first image ink dots in the primary scan direction; and in the second image-printing scan, discharges the image ink from the first nozzles while moving the discharge head in the primary scan direction so as to form the second image ink dots and then again discharges the image ink from the first nozzles while moving the discharge head in the primary scan direction so as to form other second image ink dots in the predetermined area of the recording medium and next to the already-formed second image ink dots in the primary scan direction.

5. The inkjet printer according to claim 1, wherein the second controller:

in the first base-printing scan, discharges the base ink from the second nozzles while moving the discharge head in the primary scan direction so as to form the first base ink dots and then again discharges the base ink from the second nozzles while moving the discharge head in the primary scan direction so as to form other first base ink dots in the predetermined area of the recording medium and next to the already-formed first base ink dots in the primary scan direction; and in the second base-printing scan, discharges the base ink from the second nozzles while moving the discharge head in the primary scan direction so as to form the second base ink dots and then again discharges the base ink from the second nozzles while moving the discharge head in the primary scan direction so as to form other second base ink dots in the predetermined area of the recording medium and next to the already-formed second base ink dots in the primary scan direction.

6. The inkjet printer according to claim 1, wherein the controller includes a fourth controller that instructs the third controller to perform the first and second image-printing scans and the first and second base-printing scans; then feeds the recording medium by a third feed distance in the first direction along the secondary scan direction relative to the discharge head; and then again instructs the third controller to perform the first and second image-printing scans and the first and second base-printing scans.

7. The inkjet printer according to claim 6, wherein the third feed distance is greater than about ½ of the length of the first and second nozzle rows and less than the length of the first and second nozzle rows.

8. The inkjet printer according to claim 1, wherein where n denotes the nozzle pitch, the first feed distance is a length corresponding to about $n/a+b\times n$, where a denotes an integer of two or more, and b denotes an integer of zero or more.

9. The inkjet printer according to claim 8, wherein where n denotes the nozzle pitch, the second feed distance is a length corresponding to about $n/a$, where a denotes an integer of two or more.

10. The inkjet printer according to claim 1, comprising a heater that heats the recording medium.

11. A printing method using an inkjet printer including a discharge head that includes a first nozzle row and a second nozzle row, the first nozzle row including a plurality of first nozzles arranged next to each other in a secondary scan direction to discharge an image ink, and the second nozzle row including a plurality of second nozzles arranged next to each other in the secondary scan direction to discharge a base ink, wherein the first nozzle row and the second nozzle row are arranged next to each other in a primary scan direction; a scanner that moves the discharge head in the primary scan direction that crosses the secondary scan direction; a feeder that moves at least one of the recording medium and the discharge head so as to feed the recording medium in the secondary scan direction relative to the discharge head; and a controller that controls the discharge head, the scanner and the feeder, wherein a length and a nozzle pitch of the first nozzle row in the secondary scan direction are equal or substantially equal to a length and a nozzle pitch of the second nozzle row in the secondary scan direction, the method comprising:

a first step of performing at least a first image-printing scan of discharging the image ink from the first nozzles while moving the discharge head in the primary scan direction so as to form first image ink dots in a predetermined area of the recording medium, a first minute feed of feeding the recording medium by a first feed distance in a first direction along the secondary scan direction relative to the discharge head, and a second image-printing scan of discharging the image ink from the first nozzles while moving the discharge head in the primary scan direction so as to form second image ink dots in the predetermined area of the recording medium and next to the first image ink dots in the secondary scan direction;

a second step of performing at least a first base-printing scan of discharging the base ink from the second nozzles while moving the discharge head in the primary scan direction so as to form first base ink dots in the predetermined area of the recording medium, the first minute feed, and a second base-printing scan of discharging the base ink from the second nozzles while moving the discharge head in the primary scan direction so as to form second base ink dots in the predetermined area of the recording medium and next to the first base ink dots in the secondary scan direction; and a third step of:

instructing the first controller to perform the first image-printing scan, the first minute feed and the second image-printing scan without discharging the image ink from a first nozzle that is located at an end portion of the first nozzle row in the first direction along the secondary scan direction; then performing a second minute feed of feeding the recording medium by a second feed distance in the first direction along the secondary scan direction relative to the discharge head; and then instructing the second controller to perform the first base-printing scan, the first minute feed and the second base-printing scan without discharging the base ink from a second nozzle that is located at an end portion of the second nozzle row in a second direction opposite to the first direction along the secondary scan direction; or instructing the second controller to perform the first base-printing scan, the first minute feed and the second base-printing scan without discharging the base ink from a second nozzle that is located at an end portion of the second nozzle row in the first direction along the secondary scan direction; then performing the second minute feed; and then instructing the first controller to perform the first image-printing scan, the first minute feed and the second image-printing scan without discharging the image ink from a first nozzle that is located at an end portion of the first nozzle row in the second direction along the secondary scan direction.

12. The printing method according to claim 11, further comprising:

using the third step to perform the first step of performing the first and second image-printing scans and the second step of performing the first and second base-printing scans;

then feeding the recording medium by a third feed distance in the first direction along the secondary scan direction relative to the discharge head; and again using the third step to perform the first step of performing the first and second image-printing scans and the second step of performing the first and second base-printing scans.

* * * * *